United States Patent [19]

Diederich

[11] 4,248,208

[45] Feb. 3, 1981

[54] CATALYTICALLY HEATED CURLING DEVICE WITH AUTOMATIC TEMPERATURE CONTROL

[75] Inventor: Walter J. Diederich, West Newbury, Mass.

[73] Assignee: The Gillette Company, Boston, Mass.

[21] Appl. No.: 47,351

[22] Filed: Jun. 11, 1979

[51] Int. Cl.[3] ..... A45D 1/04

[52] U.S. Cl. ..... 126/409; 132/32 R; 132/37 R

[58] Field of Search ..... 126/408, 409, 410; 132/33 R, 33 A–G, 36 R, 32 R, 36 AA, 36 C, 36 CC, 37 R; 431/147, 268, 129, 130; 251/121; 222/3

[56] References Cited

U.S. PATENT DOCUMENTS

| | | | |
|---|---|---|---|
| 1,069,164 | 8/1913 | Nilson | 126/409 |
| 1,181,134 | 5/1916 | Harper | 126/409 |
| 3,210,965 | 3/1964 | Heling | 222/3 |
| 3,835,292 | 9/1974 | Walter et al. | 132/32 R |
| 3,934,114 | 1/1976 | Godel et al. | 132/32 R |
| 4,009,367 | 2/1977 | Rizzuto | 132/32 R |

*Primary Examiner*—Samuel Scott
*Assistant Examiner*—R. J. Marett
*Attorney, Agent, or Firm*—Richard A. Wise; Raymond J. De Vellis

[57] ABSTRACT

A catalytic heating means is disposed in a heating chamber of a tubular body member defining a hair winding portion. The curling device includes a supply of a liquid fuel and aspirating means for vaporizing the fuel and mixing the vaporized fuel with air to supply a vaporized fuel/air mixture to the catalytic heating means. A temperature control means automatically regulates the flow of vaporized fuel in response to the temperature of the heating chamber.

11 Claims, 5 Drawing Figures

CATALYTICALLY HEATED CURLING DEVICE WITH AUTOMATIC TEMPERATURE CONTROL

BACKGROUND OF THE INVENTION

This invention relates to hair curling devices which are catalytically heated. More particularly this invention relates to a curling iron including means for automatically regulating the flow of vaporized fuel in response to the temperature of the curling iron.

In the past, catalytically heated curling devices were generally difficult to manufacture. That is, many prior art devices include nozzles for releasing the gaseous fuel, e.g. Great Britain Pat. No. 419,825; and U.S. Pat. Nos. 2,997,869; 3,563,251; and 3,913,592. The device of U.S. Pat. No. 3,563,251 requires its nozzle opening to be within a range of about 15 to 80 microns and formed preferably by the use of a laser.

A further disadvantage runs through the prior art which renders the prior art products ineffective for consumer use as a hair curling device operable in a simple straightforward manner to provide the user with safety, comfort, and a plurality of curls in a trouble-free manner without wasting time or fuel. This disadvantage is the lack of suitable temperature control which is necessary to prevent the user from operating the hair curling device when its barrel temperature is beyond a predetermined range.

The prior art difficulties and disadvantages have been substantially overcome by providing a curling iron which includes a catalyst means disposed in its heating chamber. Vaporizing means vaporize the fuel and the vaporized fuel is then mixed with air and supplied to the catalyst means. Temperature controls means for automatically regulating the flow of vaporized fuel in response to the temperature of the heating chamber is also provided.

SUMMARY OF THE INVENTION

It is an object of this invention to provide a safe, efficient, easy to manufacture curling iron which will operate in a straightforward manner.

It is another object of this invention to provide a butane powered, catalytically heated curling iron with temperature control means.

It is a still further object of this invention to provide a safe, reliable curling iron in which an automatic temperature control means is provided.

Briefly stated, and according to an aspect of this invention, a hand-held curling iron is provided which includes a tubular body for winding a tress of hair which defines a heating means including a catalyst. A handle portion of the curling iron forms a housing for a refillable fuel supply and a nozzle, venturi tube, and vaporizer provide aspirating means for vaporizing the liquid fuel and for mixing the vaporized fuel with air and for supplying the vaporized fuel/air mixture to the catalyst. A temperature control means including a bimetal element proximate the heating chamber and connected to the movable nozzle is utilized to control the flow of vaporized fuel and thus to provide automatic temperature control to the curling iron.

BRIEF DESCRIPTION OF THE DRAWINGS

The invention both as to its organization and principles of operation, together with further objects and advantages thereof, may better be understood by referring to the following detailed description of an embodiment of the invention taken in conjunction with the accompanying drawings in which.

DETAILED DESCRIPTION

Figure 1:
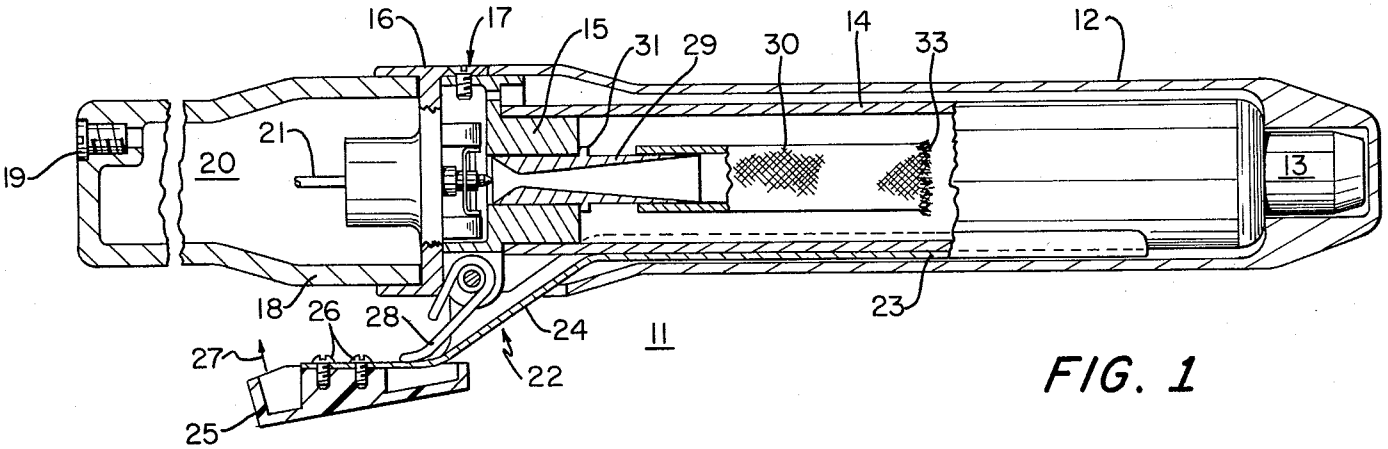
FIG. 1 is a side elevational plan view, partial in section of a curling iron, in accordance with this invention.

Referring to FIG. 1, a curling iron generally designated by the numeral 11 includes a removable sleeve or cover 12. The cover 12 which may be formed of a plastic such as a polycarbonate is disposed over a cool tip housing 13 on one end of a barrel portion 14. The cool tip housing 13, which may likewise be formed of a plastic such as a polycarbonate, is telescopically mounted in the right end of the barrel portion 14. The barrel portion 14, which is preferably made of a heat conductive material such as aluminum, is circular in cross-section and may include a plurality of air holes or rows of holes in a manner well known in the art to provide air input and an exhaust means for the consumed fuel-air mixture from the interior of the barrel portion 14.

The other end of the barrel portion 14 is connected, such as by a press fit, to the outer surface of an associated sleeve member 15. The sleeve member 15 is further connected to a housing member 16 by fastening means such as screw 17. The housing member 16 is in turn connected, such as by a press fit or by ultrasonic weld to an end of a pressure vessel 18. The pressure vessel 18, which may be formed of nylon or the like, includes a refiller valve housing 19. Valve housing 19 contains any well known refill valve system adapted to receive a mating stem of a container of butane or the like. The reservoir 20 of the vessel 18 receives and retains the fuel in a liquid state in the handle portion of the curling iron 11.

Of course, the pressure vessel 18 need not be permanently fixed to the housing member 16 of curling iron 11. Vessel 18 may be releasably attached to the curling iron 11 in order that a disposable cartridge may be utilized. In general, the reservoir 20 holds approximately 10 grams of fuel, in an exemplary embodiment, which suffices for a plurality of curling sessions.

Disposed in the reservoir 20 of the pressure vessel 18 is a wick member 21 shown partially. The pressure vessel 18 may include a wick member 21 formed as a lining covering the inner walls of the pressure vessel 18. Further, the wick member 21 may be extended to the bottom of reservoir 20 to assure that substantially all the butane fuel is utilized regardless of the orientation of the curling iron 11. The wick member 21 may be made from a fibrous material, such as filtering paper, textile materials or other absorptive material.

Connected to the exterior of the curling iron 11 is a hair clip 22, well known in the art. The hair clip 22 has a first portion 23 substantially conforming to the shape of the outer surface of the barrel portion 14. First portion 23 is integrally formed with a second portion 24 which in turn is connected to a button member 25 through fastening means such as screws 26. Portion 23 is raised outward from the barrel portion 14 when its associated button member 25 is compressed, in a direction as indicated by arrow 27 toward the pressure vessel 18. The first portion 23 and second portion 24 of the hair clip 22 may be formed of a plastic or metal. The button member 25 is preferably formed of a plastic material. The hair clip 22 is mounted through a spring member 28 to the member 15 in a manner well known in the art.

Positioned co-extensively in the barrel portion 14 is a venturi tube 29, preferably formed of a material such as aluminum. The tube 29, as is well known in the art, has an internal passageway shaped to provide an efficient mixing of air with the flow of vaporized fuel into the mouth of the tube 29. The mixture of vaporized fuel and air is presented at the exit of the tube 29 to the interior of a catalytic sleeve 30. The mouth end of the tube 29 is press fit into the cavity of sleeve member 15 until integrally formed stop member 31 abuts the sleeve member 15. About the exit or downstream end of the tube 29 a catalytic sleeve 30 is disposed.

The catalytic sleeve 30 is preferably firmed of a non-combustible fiber and woven into a sleeve. The sleeve 30 is positioned in a co-extensive manner with the tubular barrel portion 14. The sleeve 30 is treated with a catalytic material in any manner well known in the art. Preferably, such catalytic material will be a platinum/-palladium compound.

The end 33 of the catalytic sleeve 30 nearer the cool tip housing 13, which houses a self-contained ignition system to be described later, is in a preferred embodiment unravelled and substantially fills the inside of sleeve 30 at end 33. The filled end 33 acts as a flame arrestor and also increases ignition efficiency.

Although the embodiment described herein illustrates a curling iron with a fuel supply located at one end of the curling iron and an ignition system located on the other end of the curling iron, the location of such components may be juxtaposed or serve a dual function and still be within the scope of this invention.

Figure 2:
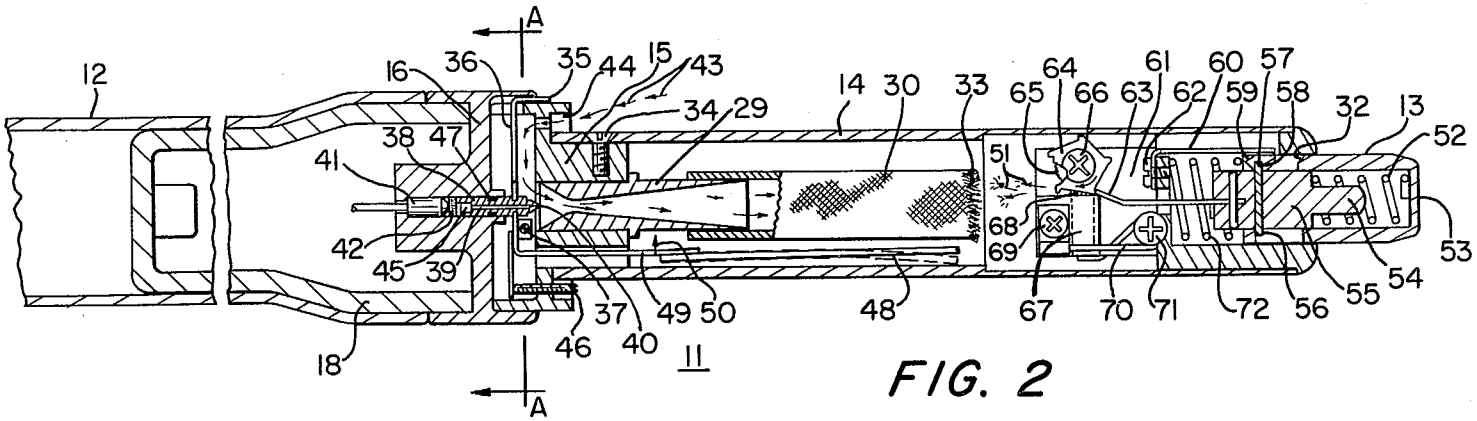
FIG. 2 is a side elevational plan view, partial in section of a curling iron and rotated 90° with respect to FIG. 1, in accordance with this invention.
Figure 3:
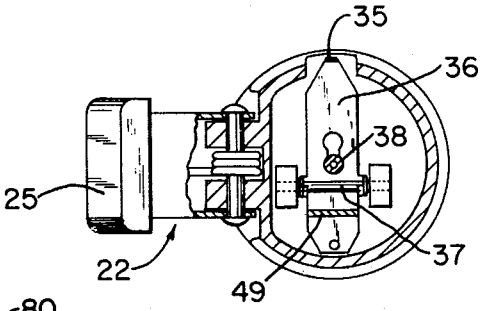
FIG. 3 is a cross-sectioned view taken along line A—A of FIG. 2, in accordance with this invention.

Referring now to FIG. 2, the cover 12 is shown removed from its position about the barrel portion 14 to a position in which the cover 12 is frictionally mated over the pressure vessel 18 to form a handle portion for the curling iron 11. When the cover member 12 is removed from the barrel portion 14, which is secured to sleeve member 15 by means of screw 34 or the like, the gas flow of the system may be automatically initiated. More specifically, and also referring to FIG. 3, the removal of the cover 12 causes an upstanding end 35 of the plate member 36 of a temperature control assembly to return to its unbiased position toward the cool tip housing 13 by pivoting about pivot point 37. Accordingly, a centrally disposed stem member 38, slidably disposed in a cavity of housing member 16 which includes a main passageway 39 and a nozzle passageway 40, is urged away from the exit surface of a vaporizing means such as a sintered metal plug 41. The upper part of stem member 38 is disposed through an aperture in the plate 36. Stem member 38 is connected to plate 36 in that the plate 36 is positioned in a circumferential groove of stem member 38. An associated fuel impervious rubber pad 42 which is connected to the bottom portion of the stem member 38 is thus urged away from the exit surface of the vaporizing means 41 and vaporized fuel flow is initiated into the main passageway 39 and nozzle passageway 40. Thus, although unnecessary for the purpose of this invention, the removal of the cover 12 from the barrel portion 14 acts as an automatic "on" by causing the vaporized fuel flow to be initiated. Conversely, an automatic "off" is provided by replacing the cover 12 on the barrel portion 14 thereby substantially preventing the vaporized fuel to flow from the vaporizing means 41 by applying sufficient force in urging the stem member 38 and its associated pad 42 by means of plate member 36 and its upstanding end 35 toward the exit surface of the vaporizing means 41. If desired, other means for achieving an automatic "on" and "off" may be included, such as by initiating vaporized fuel flow when the cover 12 is properly positioned on the handle and by terminating flow when the cover 12 is removed from the handle portion 18.

The stem member 38 with its main passageway 39 and nozzle passageway 40 accelerates the vaporized fuel and presents it to the mouth of the venturi tube 29. At the mouth of the tube 29, air will be presented to the interior of the curling iron 11 from a plurality of paths such as the pathway shown by arrows 43 travelling through an aperture 44 in sleeve member 15.

The vaporized fuel from the exit surface of the vaporizing means 41 has a sufficient pathway to go around the rubber pad 42 when the pad 42 is not in contact with the exit surface of the vaporizing means 41. Before entering the main passageway 39, the vaporized fuel may first pass through a fuel filter located in cavity 45 in the stem member 38. Once the vaporized fuel enters the main passageway 39, it is accelerated. The vaporized fuel is further accelerated when it enters the smaller in diameter nozzle passageway 40. The nozzle passageway 40 may be formed of a gem with the appropriately sized passageway bored therethrough and mounted in the tip of the stem member 38, all in a manner well known in the art, to provide an acceleration of the vaporized fuel for ultimate mixing with air at the mouth of the venturi tube 29.

The stem member 38, which is movable in the housing member 16 in an axial direction, has an "O" ring 47 disposed thereabout. The "O" ring 47 seals off the vaporized fluid flow from pathways other then through the main passageway 39 and nozzle passageway 40.

Disposed in the cavity of the barrel portion 14 is a bimetal strip 48 and having a thickness such as 0.025 inch. An end of strip 48 is joined, such as by spot welding in a manner well known in the art to arm 49 of the temperature control system. Arm 49 is integrally formed with plate 36 and is positioned generally perpendicular to plate 36 on the side of the pivot point 37 opposite the upstanding end 35. When the sensed temperature of the inside of the barrel portion 14 of the curling iron 11 reaches a predetermined temperature, the bimetal strip 48 starts to flex outward in a generally convex manner toward the inside wall of the barrel portion 14. Ultimately, the strip 48 reaches the configuration indicated by the dotted lines at which time it applies a force to arm 49 in the direction of the arrow 50. This force is translated through plate 36 and about pivot point 37 to cause a downward axial displacement of the stem member 38 toward the vaporizing means 41 which results in a termination and/or metering of the vaporized fuel flow from the exit portion of the vaporizing means 41.

A set screw 46 disposed through the sleeve member 15 cooperates with the plate member 36 and bimetal 48 to provide an adjustment of the maximum temperature.

Mounted in the free end of the barrel portion 14 is a self-contained convenient ignition system for presenting a spark 51 to the fluffed end 33 of the catalytic sleeve 30, when desired. Once the vaporized fuel/air mixture is ignited in the presence of the catalytically treated sleeve 30, a small flame may persist for a short time at the tip of the catalytic sleeve 30 within the curling iron 11. The heat radiating from this small flame initiates the catalytic oxidation of the vaporized fuel within the catalytic sleeve 30 and the oxidation process spreads over the surface of the catalytic sleeve 30. The initial flame or spark extinguishes by itself for lack of fuel and oxygen which is now consumed within the sleeve 30 before it can get to the site of the flame. The unravelled end 33 of the catalytic sleeve 30 aids in the efficiency of initial ignition as well as performing the function of a flame arrestor. The flame arrestor function substantially prevents the flame from temporarily burning off the available oxygen and ultimately blowing itself out.

Although the ignition can be accomplished by an electric spark such as from a piezoelectric ignitor, a hot wire or the like, in a preferred embodiment the ignition is accomplished by a self-contained ignition system which produces a spark from a flint. The ignition system is conveniently located on the free end of the curling iron and may be initiated whenever desired by the user by simply pressing the telescopically mounted cool tip housing 13 and axially displacing the same toward the handle portion of the curling iron 11 much in a manner in which a steam curling iron user would initiate a metered amount of water by pressing the water reservoir cool tip on the far end of the curling iron.

More specifically, and referring to FIG. 2, the self-contained ignition system includes a push/snap action release system. Mounted in the cool tip housing 13, which is telescopically movable in a direction along the major axis of the curling iron 11, a coiled spring 52 is disposed between the top wall 53 of the cool tip housing 13 and about a finger-like member 54 of a pusher 55. The pusher 55 with its upstanding finger member 54 may be formed of a plastic, brass or the like and has a sliding fit inside the housing of the cool tip 13.

A pin 56 is connected to pusher 55 and includes an end portion 57. The end portion 57 in its "at rest" position is positioned in a slot 58 of a lock member 59. The lock member 59 receives its tension through a lock spring 60 mounted to a base member 61 means of fastener or screw 62. The base member 61 is frictionally engaged in the interior of the barrel portion 14 or otherwise affixed thereto in a manner well known in the art.

In order to achieve proper relative movement of the components of the ignition system when the user presses the cool tip housing 13 to telescopically move and axially dispose the housing 13 in a direction toward the handle of the curling iron 11, the coil spring 52 is first compressed. The compression of the coil spring 52 by the displacement of the cool tip housing 13 is caused because the coil spring 52 is captured between the top wall 53 of the coil tip housing 13 and the upper surface of pusher 55 which is held stationary by the lock member 59 which captures in its slot 58 the end portion 57 of pin 56 which is connected to pusher 55. The compression causes energy to be stored in the compression spring 52 and pressure to build up on the top surface of pusher 55 until a beveled portion 32 of housing 13 contacts and lifts the lock member 59 by overcoming the force of the lock spring 60. This releases the end portion 57 and pin 56 and sets the pusher free to travel at high speed toward the handle portion of the curling iron 11 caused by the stored energy exerting pressure onto the top surface of the pusher 55.

Affixed to the pusher 55 at one end and movable therewith is an indexing means or flint actuator such as pawl 63. The free end of the pawl 63 is positioned relative to a ratchet assembly. The ratchet assembly includes a ratchet member 64 having five teeth disposed thereon which turn in a clockwise direction for a one tooth revolution when indexed by the pawl 63. Movable with the ratchet member 64 is a cylindrical file or flint sparker 65. The ratchet member 64 and its associated flint sparker 65 are secured to the base member 61 by means of a screw 66.

Also connected to the base member 61 is a flint holder 67 holding a piece of flint 68. A portion of the flint 68 is positioned proximate the flint sparker 65 such that movement of the flint sparker 65 causes a spark to result from its frictional involvement with the flint 68. The flint holder 67 and its associated flint 68 are connected to the base member 61 by means of screw 69. A torsion spring or flint spring 70 is mounted to the base member 61 by means of a screw 71 to provide the proper force in urging the flint 68 toward the flint sparker 65. The flint 68 may be readily replaced by moving the flint spring 70 out of the way to achieve access to the flint 68. When the user releases the force from the cool tip housing 13, a return spring 72 pushes the pusher 55 and its associated assembly back toward its normal position.

Figure 4:
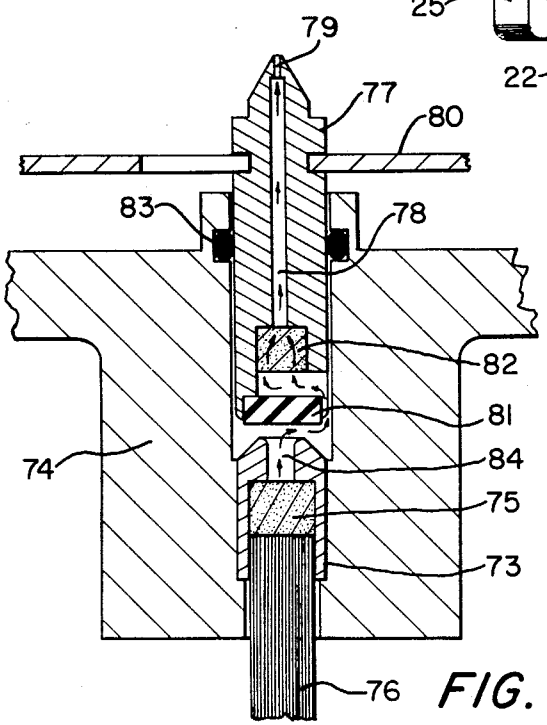
FIG. 4 is a more detailed view of the vaporizer/nozzle assembly in accordance with this invention.

Referring now to FIG. 4, a valve assembly is shown which includes an aluminum sleeve 73 pressed into a cavity formed in a housing 74 which may also be a wall of a pressure vessel containing a gas such as butane. Pressed into the sleeve 73 is a sintered metal plug 75 and a wick member 76. The wick member 76 is disposed into the interior reservoir of a pressure vessel and carries butane fuel or the like from the reservoir of a pressure vessel to the sintered metal plug 75. The sintered metal plug 75, which may be formed of a stainless steel, acts as a vaporizer and its size, shape, and material defines the maximum flow of the fuel from an associated pressure vessel, all in a manner well known in the art.

Partially disposed in the cavity formed in housing 74 is a stem member 77. Stem member 77 may be formed of plastic, brass or the like and includes a main passageway 78 and a nozzle passageway 79. Passageways 78 and 79 provide communication from the downstream or exit surface of sintered metal plug 75 to the mouth of a tube, such as the venturi tube previously described. The diameter of the main passageway may be in the range of 0.02–0.03 inch and that of the nozzle passageway may be in the range of 0.003–0.004 inch. A gem having a hole bored therethrough may be positioned in the tip end of the stem member 77 to act as a nozzle passageway.

The stem member 77, which is illustrated in its open position in FIG. 4, is axially movable in the cavity of housing 74 in response to the force presented to it from plate 80. Plate 80 receives its force when the bimetal strip shown in FIG. 2 presses against the interior wall of the barrel portion of the curling iron due to increased temperature.

Disposed on the upstream side of and fastened to the stem member 77 is a pad of a fuel impervious rubber 81 such as a Viton rubber. Disposed downstream from the fuel impervious pad 81 is an optional fuel filter member 82. Filter member 82, which may be formed of stainless steel, is press fit into a cavity of stem member 77 to provide a filtering of the butane fuel if necessary. Completing FIG. 4, an "O" ring 83 is provided which is disposed about the stem member 77 to prevent the downstream movement of the vaporized fuel other than through the nozzle passageway 79.

In operation, the flow of the vaporized fuel from the exit surface of the sintered metal plug 75 follows a path as indicated by the arrows of FIG. 4 through a valve opening 84 around the pad 81, through filter 82, through the main passageway 78 to ultimately be disposed from the tip end of nozzle passageway 79. The shape of the pad 81 will be such that the vaporized fuel flow will occur when the pad is physically separated from the top of valve opening 84. When the upstream side of the pad 81 blocks off the passageway 84, vaporized fuel flow will cease. Accordingly, when the upstream surface of the pad 81 approaches totally blocking off the vaporized fuel flow, a lessening of vaporized fuel flow will result through the system. The regulation of the vaporized fuel flow is accomplished automatically in response to the temperature of the heating chamber in a preferred embodiment.

Even when the vaporized fuel flow is cut off from the system, the catalytic operation of the catalytic sleeve 30 will continue to be "hot" for a period of time. During such time, if fuel is reintroduced to the catalytic sleeve 30, such as due to the temperature of the heating chamber or barrel decreasing sufficiently to cause a relaxation of the bimetal element and thus an axial movement upward of the associated stem member, combustion will continue in a normal manner without any need for reignition.

Figure 5:
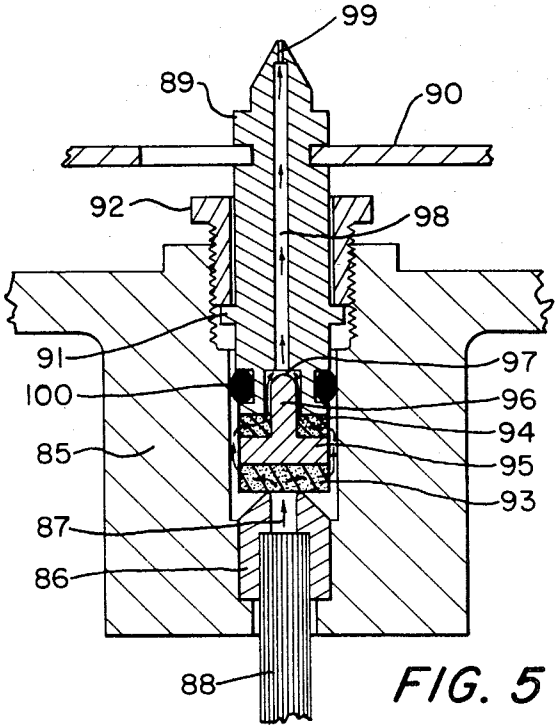
FIG. 5 is an alternate embodiment of a vaporizer/-nozzle assembly in accordance with this invention.

FIG. 5 provides a valve assembly which not only provides the on/off function of the embodiment of FIG. 4 when regulating the flow of vaporized fuel, but also provides a more even metering of vaporized fuel flow.

Mounted in a cavity formed in a housing 85 which may also be a wall of a pressure vessel is a pressed fit aluminum sleeve 86 having a valve opening 87 disposed on its downstream side. Disposed in the sleeve 86, in a manner such as by press fitting, is a wick member 88 comprised of fiber, cloth, or the like for presenting the liquid fuel in the reservoir of an associated pressure vessel to the valve opening 87. A stem member 89 rides freely in the cavity of housing 85 and is connected to a plate member 90 at an associated groove. Plate member 90 is part of the temperature control system and causes an axial downward force to be applied to the stem member 89 when the temperature of the associated heating chamber reaches and exceeds a predetermined temperature.

The stem member 89 also includes a shoulder portion 91 positioned in the cavity of the housing 85 by means of a control nut 92. The control nut 92 is screwed into the threaded downstream side of the cavity of housing 85 and its setting limits the travel of the stem member 89 and provides a maximum flow setting by deforming a two piece vaporizing means. The vaporizing means is made up of two pieces of an open cell foam such as a polyether and comprises upstream vaporizing member 93 and downstream vaporizing member 94. Disposed between the downstream vaporizing member 94 and the upstream vaporizing member 93 is a fuel impervious barrier or plunger 95 having an upstanding finger portion 96 which is disposed in a passageway 97 of the stem member 89. The passageway 97 leads in a manner described previously through a main passageway 98 and out the top of nozzle passageway 99.

An "O" ring 100 is disposed about the lower portion of the stem member 89 to prevent fluid communication downstream of the "O" ring 100 unless through main passageway 98 and the nozzle passageway 99. The foam pads or vaporizing members 93 and 94 cause a vaporization of the butane fuel from its liquid to gas state as the butane passes through their pores or cells. The amount of butane passing through the foam members 93 and 94 will be controllable depending upon the downward pressure of stem member 89 causes by the automatic temperature control means previously described. The downward pressure may also be manually actuated if desired. Preferably, the amount of butane passing through the members 93 and 94 making up the vaporizing means would be equivalent to a pressure of a water column of approximately several inches in height in the main passageway 98. This pressure forces the gas through the nozzle passageway 99 with its approximate 0.004 inch diameter and thereby produces a gas stream of sufficient velocity to aspirate air together with the vaporized gas into the mouth of a tube such as a venturi tube. Although a straight tube could be used in place of a venturi tube, the efficiency of the venturi tube is preferable. The desired fuel/air mixture at the exit of the venturi tube may preferably be on the order of ten or more parts of air to one part of vaporized fuel.

Thus, in FIG. 5, the vaporized fuel flow, when the pressure of the foam members 93 and 94 permit any flow, will travel in the direction of the arrows, through member 93, about the side of plunger 95, through foam member 94, through passageways 97 and 98, and through the tip of nozzle passageway 99 to provide vaporized fuel in the manner previously described.

While an embodiment and application of the invention has been shown and described, it will be apparent to those skilled in the art that many more modifications are possible without departing from the inventive concepts herein described. The invention, therefore, is not to be restricted except as is necessary by the prior art and by the spirit of the appended claims.

What is claimed as new and desired to be secured by Letters Patent is:

1. A curling devise comprising:

a tubular body defining a heating chamber therein and having first and second ends and a hair winding portion disposed between said first and second ends and surrounding said heating chamber;

heating means including a catalyst means disposed in said heating chamber;

a housing mounted proximate said tubular body including fuel supply means for storing a fuel in a liquid state;

aspirating means coupled between said fuel supply means and said heating chamber for vaporizing the fuel and for mixing the vaporized fuel with air and for supplying a vaporized fuel/air mixture to said catalyst means; and temperature control means for automatically regulating the flow of vaporized fuel in response to the temperature of said heating chamber.

2. A hand-held curling iron comprising:

a tubular body defining a heating chamber therein and having first and second ends and a hair winding portion disposed between said first and second ends and surrounding said heating chamber;

heating means including a catalyst means disposed in said heating chamber;

a housing mounted proximate said tubular body including fuel supply means for storing a fuel;

a movable nozzle means generally coextensive with said tubular body and positioned between said vaporizing means and said heating means for accellerating said vaporized fuel;

a venturi tube generally coextensive with said tubular body and positioned between said nozzle means and said heating means for mixing said vaporized fuel with air and for supplying a vaporized fuel/air mixture to said catalyst means; and temperature control means including a bimetal element proximate said heating chamber and further including control linkage means connected between said bimetal element and said nozzle means for controlling the axial displacement of said nozzle means thereby controlling the flow of the vaporized fuel.

3. The curling iron as in claim 2 wherein said vaporizing means includes a sintered metal plug for vaporizing the fuel.

4. The curling iron as in claim 2 wherein said vaporizing means includes a porous foam plug for vaporizing the fuel.

5. The curling iron as in claim 2 wherein said temperature control means substantially continuously meters the flow of vaporized fuel in response to the temperature of said heating chamber.

6. The curling iron as in claim 2 wherein said temperature control means substantially prevents the flow of vaporized fuel in response to a predetermined temperature of said heating chamber.

7. A hand-held curling iron comprising:

a tubular body defining a heating chamber therein and having first and second ends and a hair winding portion disposed between said first and second ends and surrounding said heating chamber;

heating means including a catalyst means disposed in said heating chamber;

a housing mounted proximate said second end of said tubular body and forming a handle including fuel supply means for storing a fuel;

vaporizing means positioned between said fuel supply means and said heating means for vaporizing the fuel;

a movable nozzle means generally coextensive with said tubular body and positioned between said vaporizing means and said heating means for accellerating said vaporized fuel;

tube means generally coextensive with said tubular body and positioned between said nozzle means and said heating means for mixing said vaporized fuel with air and for supplying a vaporized fuel/air mixture to said catalyst means; and temperature control means including a bimetal element means proximate said heating chamber and further including control linkage means connected between said bimetal element and said nozzle means for controlling the axial displacement of said nozzle means thereby controlling the flow of the vaporized fuel, wherein said bimetal element means bends in the presence of increased temperature of said heating chamber until said bimetal element means is physically obstructed from bending by the inside of said heating chamber, when so obstructed further temperature increases of said heating chamber causes said control linkage means to axially displace said moveable nozzle toward said fuel supply means.

8. The curling iron as in claim 7 further including a fuel impervious member fastened to said nozzle means and disposed between said vaporizing means and said tube means for substantially preventing the flow of vaporized fuel from said vaporizing means when said nozzle means is axially displaced a predetermined distance by said control linkage.

9. The curling iron as in claim 8 wherein said vaporizing means is a sintered metal plug and said fuel impervious member is a rubber plug.

10. The curling iron as in claim 7 further including a fuel impervious plunger member positioned between said vaporizing member and said nozzle means for compressing said vaporizing means to control the flow of vaporized fuel in accordance with the axial displacement of said nozzle means.

11. The curling iron as in claim 10 wherein said vaporizing means is an open cell foam.

* * * * *